United States Patent [19]

Ernst, deceased et al.

[11] 4,351,705

[45] Sep. 28, 1982

[54] REFINING COPPER-BEARING MATERIAL CONTAMINATED WITH NICKEL, ANTIMONY AND/OR TIN

[75] Inventors: Runyon G. Ernst, deceased, late of Woodbridge, N.J.; by Margaret Ernst, executrix, Jamesburg, N.J.; William R. Opie, Holmdel; Harold P. Rajcevic, Colonia, both of N.J.; Peter D. Parker, Brooklyn, N.Y.

[73] Assignee: Amax Inc., Greenwich, Conn.

[21] Appl. No.: 278,928

[22] Filed: Jun. 30, 1981

[51] Int. Cl.[3] ..... C25C 1/12

[52] U.S. Cl. ..... 204/108

[58] Field of Search ..... 204/108

[56] References Cited

U.S. PATENT DOCUMENTS

| | | | |
|---|---|---|---|
| 694,699 | 3/1902 | Ulke | 204/108 |
| 789,523 | 5/1905 | Betts | 204/108 |
| 882,075 | 3/1908 | Neil | 204/107 |
| 1,844,937 | 2/1932 | Hybinette | 204/108 |
| 1,920,820 | 8/1933 | Rose et al. | 204/108 |
| 2,023,424 | 12/1935 | Laist | 75/86 |
| 2,119,936 | 6/1938 | White | 204/108 |
| 2,279,900 | 4/1942 | Christensen | 75/63 |
| 2,820,705 | 1/1958 | Warner | 75/24 |
| 3,857,700 | 12/1974 | Ammann et al. | 75/63 |
| 3,984,235 | 10/1976 | Petersson et al. | 75/24 |
| 4,030,990 | 6/1977 | Piret et al. | 204/108 |
| 4,032,327 | 6/1977 | Donaldson et al. | 75/72 |
| 4,110,107 | 8/1978 | Paulson et al. | 75/72 |

FOREIGN PATENT DOCUMENTS 45843 2/1966 German Democratic Rep. .

*Primary Examiner*—R. L. Andrews

*Attorney, Agent, or Firm*—Michael A. Ciomek; Donald T. Black

[57] ABSTRACT

In a copper refinery including smelting, converting and electrolytic refining steps, feed material containing copper and contaminated with iron and one or more impurity metals selected from the group consisting of nickel, antimony, and tin is refined in a process in which the impurity metals are separated from the copper prior to the main electrolytic refining step, into a converter slag product that is subsequently smelted to form anodes which are electrolyzed in a portion of the main copper refinery electrolyte.

In another embodiment, oxidic (e.g. roasted) copper and copper-nickel concentrates are individually smelted to form anodes which are electrolyzed in separate cells between which electrolyte is cycled to maintain a balance of dissolved copper.

20 Claims, 2 Drawing Figures

REFINING COPPER-BEARING MATERIAL CONTAMINATED WITH NICKEL, ANTIMONY AND/OR TIN

BACKGROUND OF THE INVENTION

1. Field of the Invention

The present invention relates generally to the smelting and refining of copper, and more particularly to the recovery of substantially pure copper from feed material such as secondary copper-bearing scrap metal, as well as ashes, residues, dusts, slimes, and the like, and sulfidic concentrates that are roasted to oxidize the contained metal values. The copper-bearing feed material with which this invention is particularly concerned is contaminated with iron and one or more impurities such as nickel, antimony, tin, arsenic, bismuth and lead, in amounts high enough to make refining of such material impractical by conventional treatment using smelting and electrolytic refining steps.

In conventional practice, secondary copper-bearing source material is fed to a primary smelting furnace where it is smelted under moderately reducing conditions in association with one or more slag-forming components to form a smelted metal product, termed "black copper" (typically 70–80% copper) and a smelter slag product. The black copper is then converted, that is, mixed with a slag-forming agent such as silica sand and vigorously blown with air or oxygen, to form a metallic product known as blister copper (typically 95–97% copper) and a converter slag that contains impurities, including metal values, in an oxidized state. The converter slag is generally recycled to the smelter for recovery of its metal content. The blister copper is then further purified and cast into anodes, and the anodes are electrolyzed in an aqueous electrolyte containing free sulfuric acid and dissolved copper under conditions such that refined copper (over 99.90% copper) is preferentially deposited at the cathode.

In conventional processing of secondary copper-bearing material, it is necessary to limit the amounts of impurity metals, including nickel, tin, and antimony, that are contained in the copper-bearing feed material. If more than a small amount of these impurity metals are present in the copper anodes that are to be electrolytically refined, the impurity metals interfere with the electrolytic refining by causing the quality of the cathode copper deposit and the electrolytic (i.e. energy) efficiency of the refining process to deteriorate. In addition, excessive amounts of antimony or tin form relatively refractory complexes with copper and nickel in the anodes; these complexes collect in the slimes phase during electrolysis of the anodes, and increase the difficulty of treating the slimes for recovery of the metal values contained therein.

Other possible steps for preventing excessive amounts of nickel, antimony and tin from reporting to the blister copper are of little avail. Blowing the impurity metals into the converter slag is futile because, as mentioned above, this slag product is recycled to the feed smelter where the metal values in the slag merely add to the impurity load. Adjusting the conditions under which the feed material is smelted so that most of the impurity metals are driven into the smelter slag helps only to a limited extend because an unacceptable portion of the copper in the feed material also reports to the smelter slag; if the yield of copper in the black copper product is raised to an acceptable level, the impurity metal content of the black copper product rises to an unacceptable level. The slag produced in smelting the feed material usually contains metal values in sufficient quantity to justify a slag cleaning step, which is typically carried out in separate furnace, such as an electric furnace to produce a copper-bearing metal product and a discardable slag product. If excessive amounts of impurity metals are in the slag fed to the cleaning step, the furnace must be operated in a relatively inefficient manner to avoid recovering the impurity metals in the same product as the desired metal values.

Consequently, up to now it has been necessary to limit the amounts of nickel, antimony and tin contained in the copper-bearing feed to a secondary copper refinery employing the conventional sequence of smelting and electrolytic refining steps. Even so, the conditions under which the primary smelting furnace is operated are constrained by the presence of even limited amounts of such impurity metals. Restricting the impurity metal content of the feed disqualifies ever-increasing quantities of copper-bearing material from treatment by this smelting and refining procedure, since the copper is frequently associated with significant amounts of other metals. Thus, a process for recovering copper from secondary feed material which contains nickel, antimony and/or tin in amounts above those which can presently be tolerated in such refineries, and doing so in a manner which is flexible and which reduces the energy consumption per unit of refined copper produced, would be very useful.

2. Description of the Prior Art

In the present invention, some or all of the converter slag is smelted to form anodes that are subsequently electrolyzed. Several patents have recognized the desirability of recovering the metal values from slag produced in non-ferrous metal refining operations, but they do not suggest the improved process of the present invention.

For instance, U.S. Pat. No. 2,820,705 discloses a process for treating slag with a solid carbonaceous reductant under a reducing atmosphere to recover from the slag a first phase comprising a mixture of non-ferrous metal values, and a second phase containing iron and the otherwise metal-depleted slag. The patentee states that the metal mixture can be treated for refining and recovering the constituent metals; one skilled in this art would likely attempt to do so by using conventional means rather than by reintroducing the recovered metal product into a copper refinery circuit in the manner of applicants' invention.

Other processes for recovering non-ferrous metal values from slags are disclosed in U.S. Pat. No. 3,857,700, U.S. Pat. No. 3,984,235, and U.S. Pat. No. 4,032,327, all of which involve matte-based materials and effect the reduction of copper from slag into a molten matte (i.e. sulfur-bearing) phase; and U.S. Pat. No. 4,110,107, in which both copper and iron are reduced from the slag, necessitating subsequent cementation to separate the copper values from the iron.

The electrolytic decomposition of multi-metallic anodes is described in several patents, but none of these patents recognize or suggest applicants' process in which anodes from smelted converter slag are electrolyzed in copper refinery electrolyte.

East German patent publication No. 45,843 discloses a process in which a dross-copper product is treated under reducing conditions to form anodes containing e.g. 90% copper, 3.3% nickel, 1.2% lead, 1% iron, 2.6% tin, 0.45% antimony, and 0.98% sulfur. The anodes are electrolyzed in an acidic copper sulfate electrolyte, which can be conventional copper refinery electrolyte, until the electrolyte becomes turbid. The electrolyte is then boiled for a lengthy period of time under strongly oxidizing conditions to form a white-slime product containing tin oxide and antimony oxide.

In U.S. Pat. No. 1,844,937, copper-nickel matte is roasted and smelted, and the smelted product is then electrolyzed to recover a cathode copper product under conditions such that makeup copper must be supplied to the electrolyte from an external source. The makeup copper is provided as a solution obtained by leaching some of the roasted matte in sulfuric acid. Metal values are recovered from the resulting leach residue by smelting the residue to form anodes containing e.g. about 50% copper and about 50% nickel. These anodes are electrolyzed in a separate acidic electrolyte until the copper content of the electrolyte declines to a residual value of about 5 grams per liter; the residual copper is then cemented from solution by adding metallic nickel-bearing material. This disclosure is distinct from applicants' invention because in the patent the patentee is concerned with electrolysis of the product of smelting roasted matte, and of the residue of an acid leaching step, whereas the present invention does not relate to leaching processes or leach products.

In U.S. Pat. No. 2,023,424, anodes containing copper, zinc, tin and lead are electrolyzed in an aqueous sulfuric acid electrolyte. The resulting zinc sulfate electrolyte is purified of copper by the addition of a suitable amount of zinc oxide and calcium carbonate to precipitate the copper.

U.S. Pat. No. 2,279,900 describes a process for treating secondary zinc- and nickel-bearing cupreous metals. The feed material is melted and cast into anodes which are electrolyzed in sulfuric acid under conditions such that copper dissolves and is deposited at the cathode, while nickel and zinc go into solution in the electrolyte. The patentee describes only conventional techniques for controlling the concentration of dissolved metals in the electrolyte, namely electrolytically precipitating copper using insoluble anodes and then crystallizing sulfates of nickel and zinc from solution. This patent does not describe the treatment of source material containing iron, and one skilled in this art would recognize that the process described in this patent would not work acceptably with source material containing any appreciable amount of iron.

Other patents which describe the electrolysis of multimetallic anodes are U.S. Pat. No. 694,699; U.S. Pat. No. 789,523; U.S. Pat. No. 882,075; and U.S. Pat. No. 1,920,820; and U.S. Pat. No. 2,119,936.

BRIEF SUMMARY OF THE INVENTION

Stated generally, the present invention involves a process for producing high-purity copper from feed material containing copper contaminated with iron and one or more impurity metals selected from the group consisting of nickel, antimony, and tin, which comprises (1) treating the feed material to form therefrom an anode consisting essentially of copper and said one or more impurity metals, in amounts no greater than about 1 wt.% nickel, about 0.4 wt.% antimony, and about 0.2 wt.% tin, (2) electrolytically refining the anode from step (1) in an electrolytic cell comprising an aqueous sulfuric acid electrolyte in which are immersed and the anode from step (1) and a cathode, by impressing between said anode and said cathode a voltage effective to dissolve copper from said anode and preferentially deposit high-purity copper onto said cathode, wherein copper dissolves into said electrolyte at a rate which exceeds the rate of deposition of copper onto said cathode, (3) withdrawing a portion of the electrolyte, (4) providing oxidic material containing copper, iron and said one or more impurity metals, said oxidic material being selected from the group consisting of copper converter slag and roasted cupriferous concentrates, (5) smelting said oxidic material to provide a metallic anode containing copper, less than about 2 wt.% iron, and an amount of said one or more impurity metals effective, on application of the voltage in step (7), to lower the copper concentration in said electrolyte portion, (6) establishing an electrolytic cell comprising said electrolyte portion from step (3) having immersed therein the anode formed in step (5) and a cathode, (7) applying between the anode and the cathode in the cell of step (6) a voltage effective to dissolve the anode in said electrolyte portion and to preferentially deposit copper from said electrolyte portion onto the cathode, whereby the copper concentration in said electrolyte portion is lowered and said one or more impurity metals become associated with said electrolyte portion, (8) further treating said electrolyte portion to remove from association therewith an amount of said one or more impurity metals at least equal to the amount thereof contained in the anode formed in step (5), thereby providing a purified electrolyte portion, and (9) returning said purified electrolyte portion to step (2).

An advantageous embodiment of the present invention comprises a process for producing high-purity copper from secondary feed material containing copper contaminated with iron and one or more impurity metals selected from the group consisting of nickel, antimony, and tin, which comprises (A) smelting the feed material to produce a black copper product containing copper, iron, and at least about 10 wt.% of said one or more impurity metals, (B) oxidizing the iron and the one or more impurity metals in the black copper product in a converter so as to preferentially drive said oxidized material into a converter slag and to produce a blister copper product containing at least about 95 wt.% copper, (C) providing an anode from the blister copper product consisting essentially of copper and said one or more impurity metals, in amounts no greater than about 1 wt.% nickel, about 0.4 wt.% antimony, and about 0.2 wt.% tin, (D) electrolytically refining the anode from step (C) in an electrolytic cell comprising an aqueous sulfuric acid electrolytic in which are immersed the anode from step (C) and a cathode, by impressing between said anode and said cathode a voltage effective to dissolve copper from said anode and preferentially deposit high-purity copper onto said cathode, wherein copper dissolves into said electrolyte at a rate which exceeds the rate of deposition of copper onto said cathode, (E) withdrawing a portion of the electrolyte, (F) treating at least a portion of said converter slag under reducing conditions effective to recover therefrom a fully reduced metallic anode containing copper, less than about 2 wt.% iron, and an amount of said one or more impurity metals effective, on application of the voltage in step (H), to lower the copper concentration in said electrolyte portion, (G) establishing an electrolytic cell comprising said electrolyte portion from step (E) having immersed therein the anode formed in step (F) and a cathode, (H) applying between the anode and the cathode in the cell of step (G) a voltage effective to dissolve the anode in said electrolyte portion and to preferentially deposit copper from said electrolyte portion onto the cathode, whereby the copper concentration in said electrolyte portion is lowered and said one or more impurity metals become associated with said electrolyte portion, (I) further treating said electrolyte portion to remove from association therewith an amount of said one or more impurity metals at least equal to the amount thereof contained in the anode formed in step (F), thereby providing a purified electrolyte portion, and (J) returning said purified electrolyte portion to step (D).

In another embodiment, copper and nickel are recovered from concentrates containing copper and nickel in oxidic states in a process which comprises, (i) providing a roasted copper concentrate containing about 5 wt.% to about 50 wt.% copper and less than about 1 wt.% nickel, substantially all of said copper and nickel being in oxidic states, and less than about 1 wt.% sulfur, (ii) smelting said roasted copper concentrate under conditions effective to recover therefrom a blister copper product containing at least about 95 wt.% copper and a copper-smelter slag, (iii) providing from said blister copper product an anode consisting essentially of copper and up to about 1 wt.% nickel, (iv) electrolytically refining the anode from step (iii) in an electrolytic cell comprising an aqueous sulfuric acid electrolyte in which are immersed the anode from step (iii) and a cathode, by impressing between said anode and said cathode a voltage effective to dissolve copper from said anode and preferentially deposit high-purity copper onto said cathode, wherein copper dissolves into said electrolyte at a rate which exceeds the rate of deposition of copper onto said cathode, (v) withdrawing a portion of the electrolyte, (vi) providing a roasted copper-nickel concentrate containing about 5 wt.% to about 50 wt.% copper, about 3 wt.% to about 35 wt.% nickel, about 3 wt.% to about 35 wt.% iron, and less than about 1 wt.% sulfur, substantially all of said copper, nickel, and iron being in oxidic states, (vii) treating at least a portion of said roasted copper-nickel concentrate under reducing conditions effective to recover therefrom a fully reduced metallic anode containing copper, less than about 2 wt.% iron, and an amount of nickel effective, on applicant of the voltage in step (ix), to lower the copper concentration in said electrolyte portion, and to recover therefrom also a copper-nickel smelter slag containing copper, nickel, and iron values, (viii) establishing an electrolytic cell comprising said electrolyte portion from step (v) having immersed therein the anode formed in step (vii) and a cathode, (ix) applying between the anode and the cathode in the cell of step (viii) a voltage effective to dissolve the anode in said electrolyte portion and to preferentially deposit copper from said electrolyte portion onto the cathode, whereby the copper concentration in said electrolyte portion is lowered and nickel dissolves from the anode into said electrolyte portion, (x) further treating said electrolyte portion to remove from solution therein an amount of nickel at least equal to the amount thereof contained in the anode formed in step (vii), thereby providing a purified electrolyte portion, and (xi) returning said purified electrolyte portion to step (iv).

DETAILED DESCRIPTION OF THE INVENTION

Figure 1:
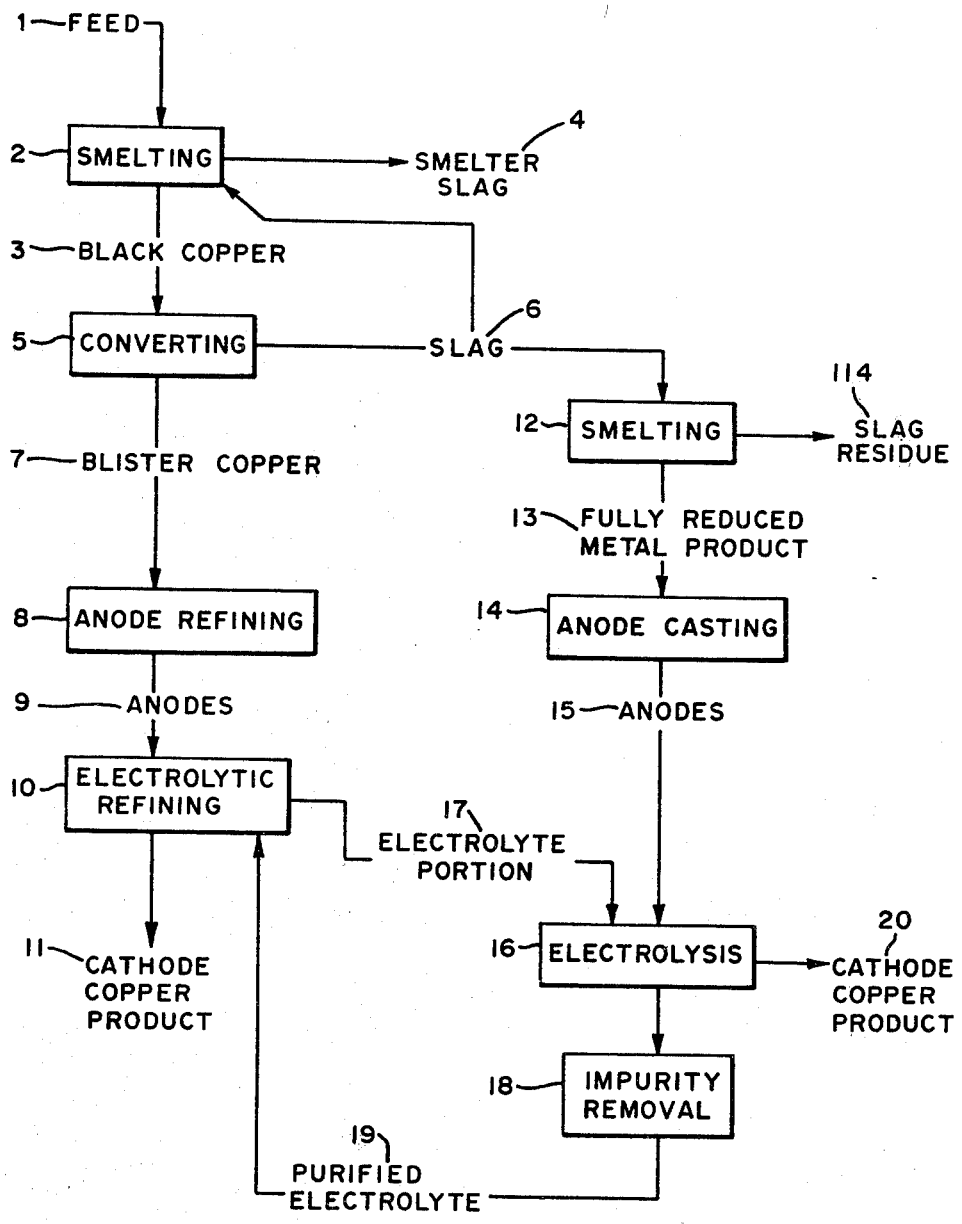
FIG. 1 is a flow sheet of a secondary copper refinery including the steps of the process of the present invention.

Referring to FIG. 1 the feed material 1 to a secondary copper smelter and refinery employing the process of the present invention contains copper, in amounts of about 15–40% by weight, and typically at least about 30% by weight. The feed material also generally contains iron, although it need not do so. Typically, iron if present comprises up to about 10 wt.% of the feed material. The feed material will also contain one or more non-ferrous impurity metals less noble than copper. Of principal concern are those metals selected from the group consisting of nickel, antimony, and tin although arsenic, bismuth, cobalt, lead, and/or zinc if present in the feed material are also separated from copper and recovered in the process of the present invention.

The process of the present invention produces high-purity copper from feed material containing at least about 2 wt.% nickel, and can also treat feed material in which the nickel content is higher, such as at least about 10 wt.%, and even over about 40 wt.%. Likewise, the process of the present invention can treat feed material containing other materials including antimony, in amounts of at least about 0.5 wt.% and event at least about 1 wt.%; and tin, in amounts of at least about 1 wt.% and even at least about 10 wt.%. The total impurity metal content of the feed material can be as high as about 50 wt.%.

The feed material, following suitable preparation such as crushing or shredding, is smelted at primary smelting stage 2 in, for instance, a short column blast furnace or cupola, or an electric furnace, under moderately reducing conditions to generate a smelted metal product and a primary smelter slag. The smelted metal product 3 (termed "black copper"), typically can have the composition given in Table I:

TABLE I

Range of Compositions of Black Copper Product

| Metal | Amount |
|---|---|
| Copper | 50–80% |
| Nickel | 0–20% |
| Antimony | 0–3% |
| Lead | 0–6% |
| Tin | 0–10% |
| Iron | 0–6% |
| Zinc | 0–5% |

The primary smelter slag 4 contains substantial amounts of iron oxide and lesser amounts of other metal oxides generally including oxides of copper, nickel, and zinc. The primary smelter slag can be discarded, or can be cleaned in a separate treatment step to recover some of the metal values contained therein.

The smelted black copper product 3 contains at least about 10 wt.% of nickel, antimony, or tin, or of combinations of two or all three of these metals. This content represents higher amounts of the impurity metals than are normally acceptable in copper refining practice. However, this aspect of the present invention is not a drawback, because the impurity metals are recovered apart from the copper in subsequent steps.

The black copper product is next subjected to a converting step 5. In this step the metal is molten, and the mixture is then vigorously oxidized by blowing it with large volumes of air or oxygen. A slagging agent such as silica sand is added, the mixture is blown again, and a converter slag is formed and recovered. This sequence of steps is generally repeated several times until the residual copper is purified to blister grade. Converting is typically carried out at about 1250° C. to about 1350° C.

The converting step 5 preferentially oxidizes metals such as iron, nickel, antimony, tin, arsenic and lead from the copper. Most of the oxides of iron, nickel, and antimony report to the converter slag 6, as do a portion of the oxides of tin and some copper. A converted, purified blister copper product 7 is formed which contains at least about 95 wt.% copper, typically 95–98% copper, and 1% or less of nickel, antimony, tin, and lead, as well as precious metals and other elements such as selenium or tellurium. Converting should advantageously be carried out under conditions effective to maximize recovery of copper into the blister copper product while minimizing the impurity content of the blister copper. If nickel, antimony, or tin is present in the black copper, a sufficient amount of these impurities should be blown into the converter slag so that anodes cast from the blister copper contain less than about 1% nickel and about 0.4% or less antimony, and less than about 0.2% tin. More advantageously, for more efficient operation in the electrolytic refining step, the impurity contents are adjusted so that the nickel content is less than about 0.5 wt.%, the antimony content is less than about 0.2 wt.%. and the tin content is less than about 0.1 wt.%. It will be understood that these figures do not imply that the anodes should contain amounts of all three of these metals.

In accordance with the present invention, a portion or all of the converter slag 6 is selected according to criteria set forth more fully below, and is retained for additional processing described below. Portions which are not so selected are recycled to the feed smelter.

The blister copper product resulting from the converting step 5 is subjected in step 8 to an additional purification step such as fire refining in a reverberatory furnace or a rotary anode furnace, to upgrade the copper content to anode copper containing about 98–99% copper and amounts, if any, of nickel, antimony, and tin within the limits given above. The copper is cast into anodes 9 which are then treated in an electrolytic refining step 10. In this step, the anodes cast from blister copper and a corresponding number of cathodes are immersed in an aqueous electrolyte containing about 120 to about 250 gpl of sulfuric acid and about 30 to about 50 gpl of copper. A voltage of about 0.1 to about 0.5 volts is applied between the anodes and the cathodes, effective to dissolve the anodes and to preferentially deposit copper on the cathode. Current density is generally about 15 to 25 amps/sq. ft.

A high purity copper product 11 deposits on the cathodes, having a purity typically comprising at least about 99.9% copper. This cathode copper can be recovered and fabricated into any number of copper products using conventional methods. If nickel is present in the anode it dissolves into the electrolyte but does not redeposit at the cathode. Other impurity metals such as antimony, tin, precious metals, selenium and tellurium are also released from the anodes and form solid products which report to a slimes phase that can be recovered from the bottom of the electrolytic cell. A small portion of the copper in the anode dissolves chemically into the electrolyte, without an equivalent amount redepositing at the cathode. Consequently the copper content of the electrolyte increases unless it is controlled in some manner. The conventional procedure for controlling the copper is electrolysis in a separate cell equipped with insoluble anodes (e.g. lead).

The converter slag 6, or a selected portion thereof, is smelted in step 12 shown in FIG. 1. Smelting can be carried out in any customary smelting apparatus such as an electric furnace or a blast furnace, under conditions such that the converter slag is molten, generally at a temperature of about 1200° C. to about 1300° C. A moderately reducing atmosphere should be maintained, for instance by adding coke or coal to the smelter in step 12.

Smelting step 12 produces a fully reduced metallic product 13, which is employed further in the present invention, and a slag residue 114, which can be discarded or treated separately to recover metal values therefrom. The smelting conditions should be effective to recover into the fully reduced metallic product a sufficient amount of the one or more impurity metals to deplete copper from the electrolyte in the electrolysis step 16 described below, and will generally recover metallic copper as well. Advantageously, recovery of the copper and other non-ferrous metal values from the converter slag into the fully reduced metal product should be maximized so as to maximize recovery of these metals in subsequent processing.

If there is iron in the converter slag, a convenient means of determining when smelting has proceeded to the appropriate extent is available. That is, the smelting conditions should be adjusted to provide that the iron content of the fully reduced metallic product is about 2% (by weight) or less and more advantageously less than about 1 wt.%. It should be recognized that as an alternative, the converter slag can be smelted so as to form a fully reduced metallic product containing more than about 2 wt.% iron; this product is then subjected to a brief converting step to drive the excess iron into a slag residue and thereby lower the iron content of the fully reduced metallic product to below about 2 wt.%.

The fully reduced metallic product 13 is then cast into anodes in step 14 in any conventional manner. An electrolytic cell 16 is then formed by immersing these anodes, together with a corresponding number of insoluble cathodes (such as copper starter sheets), into an electrolyte obtained by withdrawing an electrolyte portion 17 from the blister copper electrolytic refining step 10.

A voltage is applied between the anodes and the cathodes in electrolytic cell 16 which is effective to dissolve the anodes and to preferentially deposit copper on the cathodes. A portion or all of the anode is dissolved in this manner. A current density of about 15 to about 25 amps/sq. ft. should be maintained; higher current densities are disadvantageous because cathode deposits tend to be less coherent, whereas lower current densities disadvantageously reduce the electrolytic capacity of the cell. A voltage of about 0.1 volts to about 0.5 volts is generally satisfactory.

Dissolution of the anode releases copper, which is deposited at the cathode. Impurity metals are also released, and become associated with the electrolyte portion 17 either by going into solution in the electrolyte (e.g. nickel) or by forming insoluble compounds which report as a slimes phase that collects at the bottom of the tank (e.g. antimony and tin). To provide the slimes in a readily recoverable form while producing cathodic copper deposits of a high degree of purity, an electrolyte circulation rate of below about 0.5 liters per pound of copper deposited per hour, and more advantageously below about 0.1 l/lbCu/hr, should be maintained.

The electrolyte portion 17 is then further treated in step 18 for removal of the one or more impurity metals with which it is associated, thereby forming a purified electrolyte portion 19 which is then recycled to electrolytic refining step 10. The amount of associated impurity metals which are removed from the electrolyte portion should be at least equal to the amount thereof released by dissolution of the anode in step 16. If there is a slimes phase associated with the electrolyte portion, this phase can simply be removed by filtering, by decanting the electrolyte portion from the electrolytic cell, or by other equivalent liquid-solid separation techniques.

If the electrolyte portion contains associated therewith amounts of dissolved nickel high enough to warrent nickel removal, the electrolyte portion should first be treated to lower its copper content to below about 0.5 gpl. The copper content can be lowered to 0.5 gpl solely by electrolysis using the soluble anodes cast from smelted converter slag, or partially by such electrolysis followed by electrolysis in a separate cell (a conventional "liberator" cell) having insoluble anodes. The copper-depleted electrolyte is then heated to evaporate water and cause crude nickel sulfate (about 90% $NiSO_4.6(H_2O)$) to crystallize from solution leaving a residual acid that contains about 1000 gpl $H_2SO_4$. The nickel sulfate can be recovered, for instance by filtration. Typically, less than all of the nickel can be crystallized from the electrolyte portion because nickel sulfate has a finite solubility in the acid. The amount of nickel removed from solution should at least equal the amount that entered solution by electrolysis of the anodes in step 16. However, the amount of nickel crystallized out of solution should advantageously exceed the amount of nickel dissolved from those anodes, and should be at least equivalent to the amount of nickel introduced into solution in the electrolyte in refining step 10 through electrolysis of anodes containing small amounts of nickel.

In this manner, the impurity metal content of the converter slag, and hence of the feed to primary smelting step 2, can be recovered separately from the principal high-purity copper product 11, without requiring the impurity metals to pass through the main electrolytic refining step 10.

For greater efficiency in the recovery of the one or more impurity metals, the composition of the anodes 15 should be adjusted so that the total amount of nickel, antimony, and tin comprises about 5 wt.% to about 80 wt.% of the anodes and more advantageously about 20 wt.% to about 50 wt.%, and the balance essentially copper. The anode composition is a function of the conditions under which the converter slag is smelted. The anode composition is also a function of the composition of the portion of the converter slag 6 that is selected to be smelted to anodes. With the disclosure given herein, one skilled in this art can readily select feed material and smelting conditions to practice this process satisfactorily.

Selection of the appropriate portion of converter slag to be smelted is facilitated by the fact that in the converting of the smelted black copper product 3, converter slag is typically recovered in a series of "skims" from the surface of the molten blister copper. The composition of the converter slag recovered in each skim differs somewhat, so that the converter slag portion to be smelted to anodes can be selected depending on the particular impurities which are most significant in the material being treated. Generally speaking, it is advantageous to smelt converter slag having a low ratio of copper to the impurity being treated, for more efficient removal of impurities from the system. As can be seen in Table II, the nickel: copper ratio in the converter slag generally falls in successive skims, as does the tin:copper ratio, whereas in successive skims the antimony:-copper ratio rises somewhat. The amounts provided in Table II are of the metals per se, although the metals are of course in oxidized form in the slag.

TABLE II

Range of Composition of Black Copper Converter Slags (in wt. %)

| Metal | Skim: 1st | 2nd | 3rd |
|---|---|---|---|
| Cu | 20–25 | 30–35 | 40–45 |
| Ni | 12–15 | 12–15 | 12–15 |
| Sb | 0.2–0.3 | 0.5–0.6 | .9–1.0 |
| Sn | 6–7 | 4–5 | 2–3 |
| FeO | 15–20 | 10–15 | 6–7 |
| $SiO_2$ | 12–14 | 12–14 | 12–14 |

In addition, since the one or more impurity metals in the converter slag can eventually be recovered as byproducts of the copper refinery, the selection of converter slag to be smelted can also be based on the overall impurity metal balance of the refinery. That is, whereas considerations of copper removal from the electrolyte portion 17 during electrolysis dictate a minimum practical impurity content in the anodes from smelted converter slag, the operator is free to select a larger portion to be smelted, up to 100% of the converter slag, with reference to the amounts of the impurity metals in the feed to the primary smelting step 2. As higher amounts of nickel or another impurity metal are fed to the smelting step 2 and blown into the converter slag, portions of the converter slag containing correspondingly higher amounts of such impurities can be selected to be smelted in step 12.

Electrolysis of the anodes 15 can proceed until substantially all the copper has been removed from solution in the electrolyte portion, or for as long as the cathodic deposit 20 has the desired degree of purity. A commercially acceptable cathodic copper deposit comprising at least about 99.90 wt.% copper can be obtained by treating an electrolyte portion having an initial copper concentration of at least about 15 gpl, and more advantageously at least about 30 gpl. It has been determined that the purity of the cathodic copper deposit declines as the copper concentration of the electrolyte portion decreases, particularly as the copper concentration falls below about 15 gpl. Below about 10 gpl, purity and physical integrity of the cathode copper and electrical efficiency suffer; electrolytically deposited copper collects in the slimes products, requiring retreatment to recover the copper. Depending on the initial copper concentration of the electrolyte portion, the copper concentration can be lowered by a few gpl up to about 30 gpl or more, with higher copper removal preferred for efficient operation and lower electrolyte recycle requirements. The sulfuric acid concentration is generally about 120 gpl to about 250 gpl. The temperature of the electrolyte portion is generally about 50° C. to about 70° C.

The process of the present invention affords a number of significant advantages. Nickel, tin, and antimony are recovered from the feed material in very high yield, typically about 90% or above. The nickel sulfate crystallized from the electrolyte portion constitutes a valuable by-product of the process. The slimes phase recovered from the electrolyte portion is a rich source of the impurity metals contained therein, especially tin and antimony, and can be treated to recover these metals. Typical slimes composition is given in Table III.

TABLE III

| Metal | Amount, wt. % |
|---|---|
| Cu | 5–10 |
| Ni | 4–8 |
| Sb | 6–8 |
| Sn | 15–25 |
| Pb | 5–12 |
| Ag | 0–2 |
| As | 4–8 |

Since in the present invention nickel and other impurity metals are recovered from the secondary copper refinery as separate products without passing through the main electrolytic copper refining step, this invention permits the smelter operator to accept copper-bearing feed material containing relatively significant amounts of nickel, antimony, tin, and/or other impurity metals without sacrificing the purity of the copper product. The feed material can be smelted without concern that the extraction of impurity metals into the smelter slag should be maximized; this feature permits increased recovery of copper into the smelted black copper product. In addition, since at most only a portion of the converter slag is recycled to the primary smelting furnace, the capacity of that furnace to accept higher amounts of feed is increased without an increase in equipment size.

Since impurity metals contained in the feed to the primary smelter need not be driven into the smelter slag, the process of cleaning residual metal values from that slag can be carried out more efficiently and with a higher yield of copper and other valuable metals such as silver. Indeed, the metal product recovered from cleaning the slag 4 from the primary smelter 2 can be fed to the converting step 5 along with the black copper product 3.

As an additional advantage, this process removes copper from solution in the electrolyte in a more energy-efficient manner than conventional copper removal techniques. As mentioned above, in the electrolysis in step 10 of the anodes formed from blister copper a small portion of the copper chemically dissolves in the electrolyte not accompanied by the deposit of an equivalent amount of copper at the cathode. Electrolytic decomposition in step 16 of an anode formed from smelted converter slag, in a portion of the copper refinery electrolyte, supplies to the electrolyte portion an amount of all the metals in the anode, in proportion to their composition in the anode. Consequently, because the deposition voltage used in the electrolysis in step 16 is adjusted so as not to discharge from solution any ions other than copper, electrolytic dissolution of the anode 15 formed from smelted converter slag results in the deposition of an electrochemically equivalent amount of only copper. A gradual net depletion of the copper from the electrolyte portion 17 under treatment results.

The amount of electrolyte portion 17 withdrawn from the main electrolytic refining step 10, and the capacity for electrolytic removal of copper in step 16, should be selected with reference to the rate at which copper dissolves into the electrolyte in step 10. Advantageously, to avoid disrupting the deposition of copper in step 10, less than about 5% or even less than about 1% of the electrolyte in step 10 is withdrawn to step 16. Removing copper from the electrolyte portion with the anodes cast from the smelted converter slag consumes significantly less energy per unit of copper removed compared to the conventional copper removal techniques (e.g. techniques using insoluble anodes), while producing a higher amount of higher-grade copper than conventional decopperizing methods.

In addition, significantly less energy is consumed in refining copper from feed material containing a given quantity of impurities compared to conventional secondary smelting and refining processes. Since the concentration of nickel in the electrolyte portion increases during electrolysis of anodes 15 which contain nickel, crystallization of nickel sulfate from this nickel-enriched solution in step 18 requires less energy input to recover a given quantity of nickel sulfate.

Another feature of the present invention is its flexibility, including its adaptability to existing operations without requiring entensive additional equipment. It should be recognized that the process of this invention can be carried out batchwise, continuously, or intermittently. That is, the converter slag recovered in a particular refining campaign need not be completely consumed in that same campaign; rather, converter slag can be stockpiled smelted or unsmelted, and can be selectively employed for use in subsequent periods of copper refinery operation. This feature provides in turn an additional method for maintaining a sufficient impurity metal content in the anodes cast from the smelted converter slag to maintain electrical efficiency and to maintain a desired impurity metals balance around the refinery; for instance, converter slag high in impurity metals can be blended with other slag low in impurities, and the blend smelted to make up satisfactory anodes. If it is desired to increase the consumption of smelted converter slag in a given electrolytic operation, where warranted by the balance between the impurity metal content of the anodes and the copper content of the electrolyte portion, the copper content of the electrolyte portion can be artificially increased by the addition of a suitable amount of a soluble copper compound such as copper sulfate. Subsequent electrolysis of the resulting copper-enriched solution increases the amount of anodes from smelted converter slag which can be decomposed in a given quantity of electrolyte portion before the copper content in solution falls too low. As another example of the flexibility of this invention, the operator can use one smelting furnace alternately for smelting feed material, and then smelting converter slag, without having to set up an extra smelting furnace for practicing the present invention, and can set aside an isolated portion of an existing anode copper electrolytic tankhouse for use in electrolyzing the anodes cast from smelted converter slag.

Figure 2:
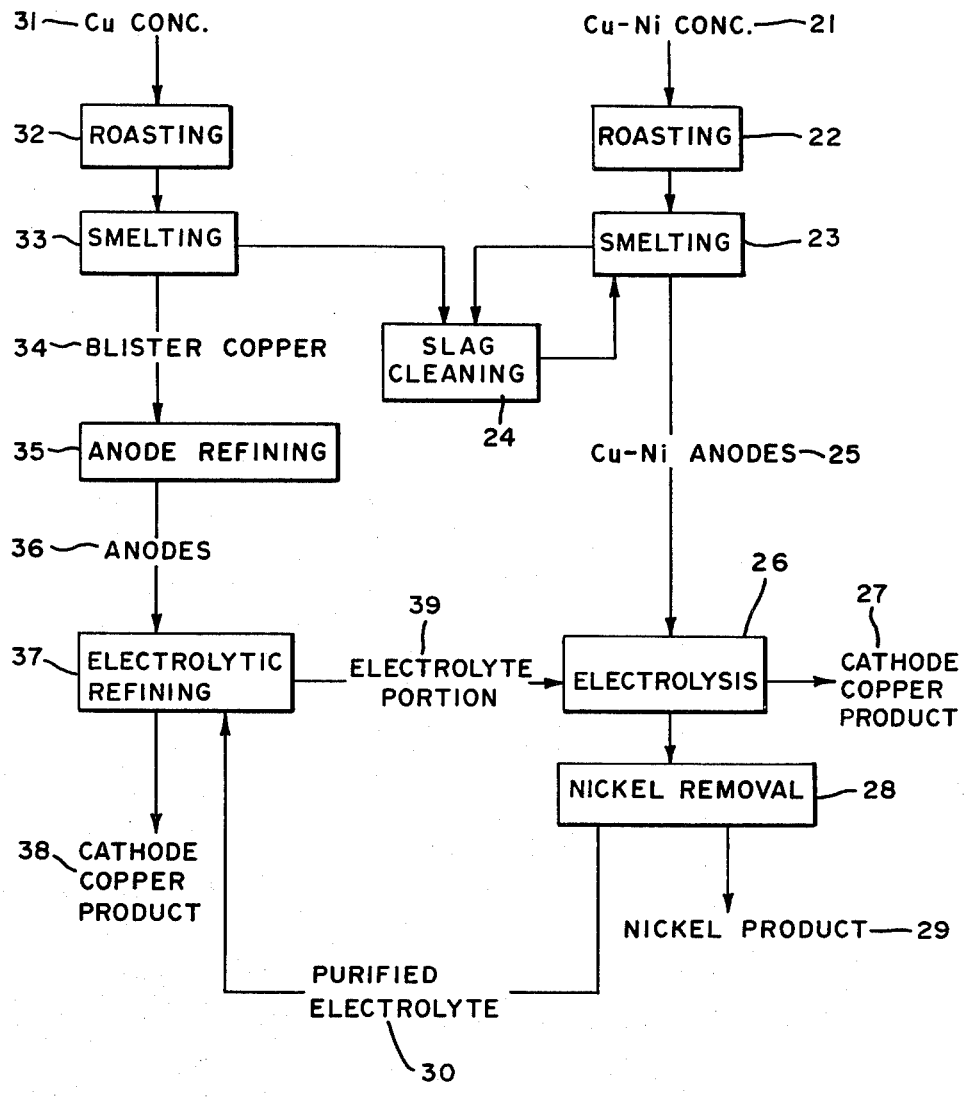
FIG. 2 is a flow sheet of another embodiment of the present invention, adapted for treatment of roasted copper and copper-nickel concentrates.

Referring now to FIG. 2, the present invention is also adaptable to treatment of the highly oxidized material produced by roasting a sulfidic copper- and nickel-bearing concentrate 21. Such a concentrate typically contains mixed sulfides of copper, nickel, and iron. The concentrate can be produced by froth flotation of finely divided copper-nickel mineralized ore.

The concentrate is conveniently dead-roasted in step 22, for instance by heating it to about 750° C. to about 950° C. in a fluid bed roaster, to provide roasted material having a sulfur content below about 1 wt.% and more advantageously below about 0.5 wt.%. Roasting converts the metals contained in the concentrate to oxidic states. The dead-roasted material contains generally about 5 wt.% to about 50 wt.% copper, about 3 wt.% to about 35 wt.% nickel, about 3 wt.% to about 35 wt.% iron, and lesser amounts of other metals such as lead, zinc, selenium, tellurium, and precious and platinum group metals.

The dead-roasted material is then smelted in step 23, in the same manner as the converter slag is smelted in step 12 described above, producing a fully reduced metallic product containing less than about 2 wt.% iron and more advantageously less than about 1 wt.% iron. The smelting conditions should be effective to maximize the recovery of copper and nickel into the metal product, while maintaining the low iron content disclosed herein. Smelting also produces a slag containing iron and small amounts of copper and nickel. This slag can be cleaned in a separate stage 24, in particular in an electric furnace, to recover metal values from the slag. The recovered metal values can then be recycled to the concentrate smelting step 23. The metallic product of the smelting step should contain nickel, in amounts of about 5 wt.% to about 80 wt.% and advantageously about 20 wt.% to about 50 wt.%, and the balance essentially copper. This product is then cast into anodes 25, which are electrolytically dissolved in step 26 in the same manner described above with respect to step 16. That is, the anodes 25 are immersed in an aqueous sulfuric acid electrolyte along with a corresponding number of cathodes, and a voltage is applied that is effective to dissolve the anodes and to plate out only copper onto the cathodes, thereby forming copper product 27. The electrolyte should contain at least about 15 gpl of copper, and advantageously at least about 30 gpl of copper. During electrolysis the copper concentration of the electrolyte decreases and the nickel concentration of the electrolyte increases.

For the reasons described above with respect to electrolysis step 16, electrolysis in step 26 is allowed to proceed to an extent determined by the desired quality of the cathodic deposit 27, by the desired degree of dissolution of the anodes 25, and by the desired final copper content of the electrolyte. When the voltage is discontinued, if the copper concentration of the electrolyte is above about 0.5 gpl, the electrolyte is transferred to a conventional liberator cell for removal of copper until a residual copper concentration of less than about 0.5 gpl is reached. The decopperized electrolyte is then treated in step 28 to remove a nickel product; nickel removal can be accomplished by electrolytically recovering nickel metal, or by crystallizing nickel sulfate ($NiSO_4.6(H_2O)$) which is recovered as a separate product.

It will be apparent that the electrolyte which is used in the electrolysis of copper-nickel anodes 25 can be drawn from an electrolytic refining stage, such as step 10 of FIG. 1, in which a nearly-pure copper anode is refined into high-purity cathodic copper by electrolysis under conditions such that a small portion of copper chemically dissolves from the anode without the deposition of an equivalent amount of copper at the cathode. As discussed above, the electrolyte must be treated in some manner to remove copper from solution to maintain a balanced copper concentration; electrolyzing copper-nickel anodes 25 in such electrolyte is an energetically advantageous manner of removing copper from this electrolyte.

In another, particularly advantageous embodiment, the electrolyte for electrolysis step 26 is drawn from the electrolytic refining of copper anodes prepared from sulfidic copper concentrates 31. Such concentrates are frequently obtained by the froth flotation of finely divided copper sulfide-bearing ore. Indeed, minerals frequently occur as mixed sulfides of copper and nickel and can be treated in an integrated froth flotation process to recover selectively a copper concentrate as well as a copper-nickle concentrate of the type described above. The copper concentrate contains nickel, but in much smaller amounts relative to the amount of copper, generally below about 1 wt.% of the concentrate.

The copper concentrate is dead-roasted in step 32, typically at about 750° C. to about 950° C. in a hearth-type roaster, to provide roasted material having a sulfur content below about 1 wt.% and more advantageously below about 0.5 wt.%. Roasting converts the metals in the concentrate to oxidic states. The roasted material contains generally at least about 5 wt.% to about 50 wt.% copper, up to about 1 wt.% nickel, up to about 1 wt.% iron, and lesser amounts of other metals such as lead, zinc, selenium, tellurium, and precious and platinum group metals.

The dead-roasted copper concentrate is then smelted in step 33, for instance in a blast furnace or electric arc furnace, with the addition of a reductant such as coke, to produce a blister copper product 34 containing at least about 95 wt.% copper. The blister copper should contain less than about 1 wt.% nickel, and more advantageously less than about 0.5 wt.% nickel. The iron content of the blister copper should be below about 1 wt.%. The blister copper is further refined in step 35, for instance in a reverberatory furnace or rotary anode furnace, to upgrade the copper to anode-grade copper containing about 98–99 wt.% copper. This copper is then cast into anodes 36, which are electrolytically refined in step 37 in an aqueous electrolyte containing typically about 120 gpl to about 250 gpl of sulfuric acid and about 30 gpl to about 50 gpl of copper. A voltage of 0.1 to about 0.5 volts is applied, effective to dissolve the anode and preferentially deposit copper at the cathode 38. Current density is generally about 15 to about 25 amps/sq. ft.

Since copper in the anodes in step 37 dissolves chemically as well as electrolytically, the copper content of the electrolyte tends to increase. To counteract this effect, an electrolyte portion 39 is withdrawn and used as the electrolyte in the electrolysis 26 of the copper-nickel anodes 25 prepared in accordance with the foregoing disclosure.

Smelting stages 23 and 33 produce slag, which contains copper and nickel values as well as iron and other impurities. These slag products can be cleaned together in slag cleaning step 24, to produce a discardable cleaned slag product and a metallic copper-nickel product that is recycled to smelting stage 23.

The volume of electrolyte portion 39 that is withdrawn from stage 37 is selected with reference to the rate at which copper is chemically dissolved into the electrolyte in step 37. The copper- and nickel-depleted electrolyte 30 is recycled to stage 37.

This embodiment of the invention recovers copper and nickel separately from roasted concentrates containing both metals, in a manner which is energetically efficient compared to other methods for treating copper-nickel feed materials.

The invention is described further in the following Examples, which should be construed as illustrative and not limiting.

EXAMPLE 1

Three batches of a fully reduced metal product were prepared from a total of 1400 lb of converter slag from a secondary copper refinery. This slag, containing 27.1 wt.% Cu, 7.0 wt.% Fe, 5.14 wt.% Pb, 4.8 wt.% Ni, 4.4 wt.% Zn, and 4.1 wt.% Sn (all metals in oxidized form), was mixed with 140 lb of washed sea sand (94% $SiO_2$), 140 lb of limestone (58% CaO), and 70 lb of metallurgical coke (90% fixed carbon). Reagent ratios were 5 lb of carbon per 100 lb of converter slag, and 1 part of sand and 1 part of limestone per part of FeO in the converter slag. 250 lb of this mixture was charged cold to a double electrode (dia, 2.5 in; graphite), single phase, 100 kva arc furnace having about 5 sq. ft. of hearth area and a bath depth of 5–6 in under the electrodes. An arc was struck, and the mixture was molten and brought to a temperature of 1300° C. The molten mixture was held at 1300° C., and after 1 hour additional 10–15 lb lots of the slag-coke-flux mixture were added every 5 minutes until the total charge to the furnace was about 450–500 lb per batch. The bath was held at 1300° C. for another 15–20 minutes, and metal and slag residue fractions which had collected in the furnace were separately tapped out, cooled, and analyzed. The 3 metal fractions, which comprised fully reduced metal, and the slag residue had the following characteristics:

| Fraction: Weight: | A 76 lb | B 142 lb | C 181 lb | Slag residue 1045 lb |
|---|---|---|---|---|
| Copper, lb (%) | 58.98 (77.60) | 106.22 (74.80) | 137.02 (75.70) | 16.41 (1.57) |
| Iron, lb (%) | 0.41 (0.54) | 0.10 (0.07) | 0.12 (0.06) | 133.76 (12.80) |
| Nickel, lb (%) | 8.89 (11.70) | 18.89 (13.30) | 24.62 (13.60) | 5.60 (0.54) |
| Tin, lb (%) | 4.73 (6.23) | 10.85 (7.64) | 13.19 (7.29) | 10.66 (1.02) |
| Lead, lb (%) | 1.22 (1.60) | 2.70 (1.90) | 2.55 (1.41) | 14.60 (1.40) |
| Zinc, lb (%) | 0.14 (0.19) | 0.09 (0.06) | 0.10 (0.05) | 24.45 (2.34) |

An electrolytic cell was established containing 7 anodes, 3 of which were cast from Fraction B and 4 of which were cast from Fraction C, interleaved with 8 sheets of Type 316 stainless steel that served as cathodes. These electrodes, each measuring $8\frac{3}{4}\times6\frac{1}{4}$ sq. in, were immersed in tankhouse electrolyte drawn from a secondary copper refinery's blister copper electrolytic refining section. The total volume of electrolyte treated was 112 liters. The electrolyte initially contained 46.9 gpl Cu, 20.9 gpl Ni, 180 gpl $H_2SO_4$, 0.21 gpl Sn, 0.73 gpl Sb, 1.81 gpl As, and 0.08 gpl Fe. Electrolyte temperature was maintained at about 75° C. Voltage was applied to maintain an average current density of 15 amps/sq. ft. between the electrodes. The voltage during electrolysis rose unevenly; its initial value was about 0.13 volts, and after 193 hours the voltage was about 0.26 volts.

| Time (hrs) | Electrolyte (gpl) Cu | Ni | Cathode Impurities (ppm) Sn | As | Sb | Ag | Ni | Pb | Zn | Fe |
|---|---|---|---|---|---|---|---|---|---|---|
| 146 | 21.8 | 36.6 | 25 | 5 | 8 | 28 | 11 | 7 | 2 | 16 |
| 194 | 12.4 | 42.4 | 110 | 5 | 14 | 27 | 23 | 7 | 2 | 11 |

Slimes formed during electrolysis on both the anode and the cell bottom. The slimes were collected after 194 hrs, analyzed, and found to have the following composition (in. wt.%):

| Source | Sn | Cu | Ni | As | Sb | Fe | Ag | Zn | Pb |
|---|---|---|---|---|---|---|---|---|---|
| Anode (1465g) | 35.7 | 8.24 | 0.74 | 2.28 | 6.00 | 0.042 | 0.52 | 0.017 | 10.8 |
| Cell (2819g) | 32.8 | 15.3 | 0.70 | 4.61 | 6.00 | 0.05 | 0.30 | 0.009 | 6.97 |

EXAMPLE 2

Two batches of a fully reduced metal product were prepared from a total of 1000 lb of converter slag from a secondary copper refinery. This slag, containing 27.0 wt.% Cu, 15.0 wt.% Fe, 4.08 wt.% Pb, 4.8 wt.% Ni, 4.3 wt.% Zn, and 3.9 wt.% Sn (all metals in oxidized form), was mixed with 100 lb of washed sea sand (92% $SiO_2$), 100 lb of limestone (58% CaO), and 50 lb of metallurgical coke (90% fixed carbon). Reagent ratios were 5 lb of carbon per 100 lb of converter slag, and 1 part of sand and 1 part of limestone per part of FeO in the converter slag. 250 lb of this mixture was charged cold to a double electrode (dia, 2.5 in; graphite), single phase, 100 kva arc furnace having about 5 sq. ft. of hearth area and a bath depth of 5–6 in under the electrodes. An arc was struck, and the mixture was molten and brought to a temperature of 1300° C. The molten mixture was held at 1300° C., and after 1 hour additional 10–15 lb lots of the slag-coke-flux mixture were added every 5 minutes until the total charge to the furnace was about 500 lb per batch. The bath was held at 1300° C. for another 15–20 minutes, and metal and slag residue fractions which had collected in the furnace were separately tapped out, cooled, and analyzed.

The 2 metal fractions, which comprised fully reduced metal, and the slag residue had the following characteristics:

| Fraction: Weight: | A 110.0 lb | B 120.0 lb | Slag residue 776.0 lb |
|---|---|---|---|
| Copper, lb (%) | 90.31 (82.10) | 93.12 (77.60) | 16.07 (2.07) |
| Iron, lb (%) | 0.02 (0.02) | 0.04 (0.04) | 179.73 (23.16) |
| Nickel, lb (%) | 11.55 (10.50) | 14.88 (12.40) | 8.41 (1.08) |
| Tin, lb (%) | 6.47 (5.88) | 8.26 (6.88) | 12.89 (1.66) |
| Lead, lb (%) | 1.08 (0.98) | 2.16 (1.80) | 18.24 (2.35) |
| Zinc, lb (%) | 0.02 (0.02) | 0.02 (0.02) | 15.88 (2.05) |

EXAMPLE 3

An electrolytic cell was established containing 7 anodes, of varying composition as follows. These anodes were made by smelting converter slag from a secondary copper refinery and casting the metal thus produced into anodes. In 6 of the 7 anodes, additional amounts of metallic cobalt and nickel were added prior to casting the anodes.

| No. of Anodes | All compositions in % by weight | | | | | | |
|---|---|---|---|---|---|---|---|
| | Cu | Ni | Co | Sn | Pb | Zn | Fe |
| 1 | 77.6 | 12.4 | 0.0 | 6.88 | 1.80 | 0.016 | 0.036 |
| 2* | 55.6 | 29.6 | 5.12 | 5.96 | 1.79 | 0.15 | 0.62 |
| 2 | 43.1 | 46.4 | 4.70 | 4.10 | 0.94 | 0.053 | 0.04 |
| 1 | 39.4 | 45.3 | 9.18 | 3.53 | 0.96 | 0.034 | 0.14 |
| 1 | 35.6 | 50.1 | 9.73 | 3.31 | 0.92 | 0.060 | 0.10 |

*Also contained 0.006% As, 0.72% Sb.

The anodes were interleaved with 8 sheets of Type 316 stainless steel that served as cathodes. These electrodes, each measuring $8\frac{3}{4}\times6\frac{1}{4}$ sq. in, were immersed in tankhouse electrolyte drawn from a secondary copper refinery's anode copper electrolytic refining section. The total volume of electrolyte treated was 133 liters. The electrolyte initially contained 44.3 gpl Cu, 22.0 gpl Ni, 221 gpl $H_2SO_4$, 0.22 gpl Sn, 0.40 gpl Sb, 2.00 gpl As, 0.96 gpl Fe, and no cobalt. Electrolyte temperature was maintained at about 60° C. Voltage was applied to maintain an average current density of 15 amps/sq. ft. between the electrodes. The voltage during electrolysis rose unevenly; its initial value was about 0.18 volts, and after 73 hours the voltage was about 0.25 volts.

The copper and nickel contents (in gpl) of the electrolyte and the impurity content (in ppm) of the cathodic copper deposit which formed after 72 hours, were as follows:

| Time (hrs) | Electrolyte (gpl) | | Cathode Impurities (ppm) | | | | | | | |
|---|---|---|---|---|---|---|---|---|---|---|
| | Cu | Ni | Sn | As | Sb | Ag | Ni | Pb | Zn | Fe |
| 72 | 16.7 | 35.6 | 45 | 13 | 8 | 30 | 16 | 5 | 2 | 33 |

Slimes formed during electrolysis on both the anode and the cell bottom. The slimes were collected after 144 hrs, analyzed, and found to have the following composition (in wt.%):

| Source | Sn | Cu | Ni | Co | As | Sb | Pb |
|---|---|---|---|---|---|---|---|
| Anode (526g) | 22.7 | 9.40 | 4.56 | 0.24 | 7.75 | 4.80 | 1.43 |
| Cell (427g) | 29.0 | 2.66 | 0.73 | 0.035 | 6.65 | 5.76 | 15.3 |

EXAMPLE 4

50 tons of converter slag from a secondary copper refinery was mixed with 2.5 tons of washed sea sand (90% $SiO_2$), 6 tons of limestone (50% CaO) and 3 tons of metallurgical coke (90% fixed carbon). This mixture was charged to a 6000 kva electric arc furnace and heated to about 1300° C. Separate, molten metal and slag fractions formed, and were tapped off and analyzed.

| Metal | Converter Slag (50 tons) | Metal Produced (16 tons) | Slag Produced (39 tons) |
|---|---|---|---|
| Cu | 27.7 | 67.6 | 1.72 |
| Ni | 12.7 | 16.9 | 1.07 |
| Sn | 4.4 | 6.5 | 0.6 |
| Sb | 0.32 | 1.03 | 0.06 |
| As | 0.02 | 0.07 | 0.002 |
| Fe | 14.7 | 2.0 | 23.7 |
| Pb | 2.9 | — | — |
| Zn | 1.8 | — | — |
| Ag | 30 | 77 | 1.5 |
| Au | 0.8 | 1.5 | 0.1 |

(All amounts in wt.% except Ag and Au are in oz. per ton).

9.92 tons of the metal produced by smelting the converter slag was formed into 30 anodes, which were interleaved with 31 copper starter sheets as cathodes, in an aqueous electrolyte containing about 150 gpl $H_2SO_4$, about 40 gpl Cu ion, and about 20 gpl Ni ion. The electrolyte circulation rate was about 0.1 liters per pound of Cu plated out per hour, and the electrolyte temperature was about 65° C. Current was applied at a density of about 16 amps per square foot, which caused the anodes to dissolve and a slimes phase to form. Copper was removed from solution in the electrolyte onto the cathode. The compositions of the cathode and the slimes are given below:

| Metal | Cathode (ppm) | Slimes (wt. %) |
|---|---|---|
| Cu | (balance) | 15 |
| Ni | 30 | 2.5 |
| Sn | 12 | 31 |
| Sb | 35 | 6.0 |
| As | — | 5.0 |
| Pb | 8 | 7 |
| Zn | 1 | — |
| Bi | 2.5 | — |
| P | 3 | — |
| Te | 0.2 | 0.25 |
| Ag | 40 | 7 |

EXAMPLE 5

1455 tons of converter slag from a secondary copper refinery was mixed with 72.75 tons of washed sea sand (90% $SiO_2$), 174.5 tons of limestone (50% CaO), and 87.3 tons of metallurgical coke (90% fixed carbon). This mixture was charged to a cupola blast furnace (14 ft×7 ft) and smelted at about 1300° C. Separate, molten metal and slag fractions formed, and were tapped off and analyzed. The slag fraction was cleaned in a 6000 kva electric arc furnace from which metal and discard slag products were recovered.

| Metal | Converter Slag (1455 tons) | Metal Produced (420 tons) | B.F. Slag Fraction | Discard Slag |
|---|---|---|---|---|
| Cu | 22 | 63.9 | 2.07 | 1.3 |
| Ni | 8.5 | 21.5 | 2.25 | 1.6 |
| Sn | 3.5 | 7.2 | 1.41 | 1.1 |
| Sb | 0.4 | 1.02 | 0.045 | 0.029 |
| Fe | 13.2 | 0.5 | 28.2 | 29.0 |
| Pb | 1.34 | 2.7 | 2.96 | 2.8 |
| Zn | 3.3 | 0.5 | — | — |
| Ag | 17.2 | 43.2 | 0.81 | 0.5 |
| Au | 0.23 | 0.14 | 0.009 | 0.006 |

(All amounts in wt.% except Ag and Au are in oz. per ton.) The metal product was cast into anodes and electrolyzed (along with other anodes produced by smelting converter slag) in an aqueous electrolyte containing about 150 gpl $H_2SO_4$, about 40 gpl Cu ion, and about 20 gpl Ni ion. Copper starter sheets were used as cathodes. Current density was 16 amps per square foot. Electrolyte circulation rate was about 0.1 liters per pound of copper deposited per hour; electrolyte temperature was about 65° C. Copper was deposited on the cathodes, and a slimes phase formed. The compositions of the cathodic deposit and the slimes are given below:

| Metal | Cathode (ppm) | Slimes (wt. %) |
|---|---|---|
| Cu | (balance) | 11.2 |
| Ni | 42 | 7.4 |
| Sn | 25 | 19.7 |
| Sb | 23 | 8.5 |
| Fe | 40 | 0.5 |
| Pb | 9 | 5.6 |
| Zn | 2 | — |
| Ag | 20 | 0.83 |
| Au | — | 5.6 Oz/Ton |

EXAMPLE 6

A sulfidic copper-nickel concentrate obtained by froth flotation of sulfidic mineralized material was dead-roasted to eliminate about 98% of its sulfur content. The resulting roasted material, containing copper and nickel as oxides, was mixed with an amount of silica sand corresponding to 10% by weight of the roasted material and the mixture was smelted in a 12-inch blast furnace to produce copper-nickel metal and slag product.

The weights of the feed material (after silica sand addition), and of the metal and slag produced in the smelter, as well as the copper, nickel, iron, and sulfur contents (all in wt.%), were as follows:

| Material | Weight | Cu | Ni | Fe | S |
|---|---|---|---|---|---|
| Feed | 1760 lb | 6.85 | 3.13 | 29.5 | 0.86 |
| Metal | 115 lb | 71.3 | 19.9 | 2.39 | 6.0 |
| Slag | 1175 lb | 3.43 | 2.6 | 44.0 | — |

The metal product was amenable to a short blow in a converter to lower the iron and sulfur contents of the metal to acceptable levels prior to electrolysis of the metal.

What is claimed is:

1. A process for producing high-purity copper from feed material containing copper contaminated with iron and one or more inpurity metals selected from the group consisting of nickel, antimony, and tin, which comprises (1) treating the feed material to form therefrom an anode consisting essentially of copper and said one or more impurity metals, in amounts no greater than about 1 wt.% nickel, about 0.4 wt.% antimony, and about 0.2 wt.% tin, (2) electrolytically refining the anode from step (1) in an electrolytic cell comprising an aqueous sulfuric acid electrolyte in which are immersed the anode from step (1) and a cathode, by impressing between said anode and said cathode a voltage effective to dissolve copper from said anode and preferentially deposit high-purity copper onto said cathode, wherein copper dissolves into said electrolyte at a rate which exceeds the rate of deposition of copper onto said cathode, (3) withdrawing a portion of the electrolyte, (4) providing oxidic material containing copper, iron, and said one or more impurity metals, said oxidic material being selected from the group consisting of copper converter slags and roasted cupriferous concentrates, (5) smelting said oxidic material to provide a metallic anode containing copper, less than 2 wt.% iron, and an amount of said one or more impurity metals effective, on application of the voltage in step (7), to lower the copper concentration in said electrolyte portion, (6) establishing an electrolytic cell comprising said electrolyte portion from step (3) having immersed therein in anode formed in step (5) and a cathode, (7) applying between the anode and the cathode in the cell of step (6) a voltage effective to dissolve the anode in said electrolyte portion and to preferentially deposit copper from said electrolyte portion onto the cathode, whereby the copper concentration in said electrolyte portion is lowered and said one or more impurity metals become associated with said electrolyte portion, (8) further treating said electrolyte portion to remove from association therewith an amount of said one or more impurity metals at least equal to the amount thereof contained in the anode formed in step (5), thereby providing a purified electrolyte portion, and (9) returning said purified electrolyte portion to step (2).

2. A process according to claim 1 for producing high-purity copper from secondary feed material containing copper contaminated with iron and one or more impurity metals selected from the group consisting of nickel, antimony, and tin, comprising (A) smelting the feed material to produce a black copper product containing copper, iron, and at least about 10 wt.% of said one or more impurity metals, (B) oxidizing the iron and the one or more impurity metals in the black copper product in a converter so as to preferentially drive said oxidized material into a converter slag and to produce a blister copper product containing at least about 95 wt.% copper, (C) providing an anode from the blister copper product consisting essentially of copper said one or more impurity metals, in amounts no greater than about 1 wt.% nickel, about 0.4 wt.% antimony, and about 0.2 wt.% tin, (D) electrolytically refining the anode from step (C) in an electrolytic cell comprising an aqueous sulfuric acid electrolyte in which are immersed the anode from step (C) and a cathode, by impressing between said anode and a cathode a voltage effective to dissolve copper from said anode and preferentially deposit high-purity copper onto said cathode, wherein copper dissolves into said electrolyte at a rate which exceeds the rate of deposition of copper onto said cathode, (E) withdrawing a portion of the electrolyte, (F) treating at least a portion of said converter slag under reducing conditions effective to recover therefrom a fully reduced metallic anode containing copper, less than about 2 wt.% iron, and an amount of said one or more impurity metals effective, on application of the voltage in step (H), to lower the copper concentration in said electrolyte portion, (G) establishing an electrolytic cell comprising said electrolyte portion from step (E) having immersed therein the anode formed in step (F) and a cathode, (H) applying between the anode and the cathode in the cell of step (G) a voltage effective to dissolve the anode in said electrolyte portion and to preferentially deposit copper onto the cathode, whereby the copper concentration in said electrolyte portion is lowered and said one or more impurity metals become associated with said electrolyte portion, (I) further treating said electrolyte portion to remove from association therewith an amount of said one or more impurity metals at least equal to the amount thereof contained in the anode formed in step (F), thereby providing a purified electrolyte portion, and (J) returning said purified electrolyte portion to step (D).

3. The process of claim 2 wherein the electrolyte portion withdrawn in step (E) contains dissolved therein at least about 30 gpl copper.

4. The process of claim 2 wherein in step (H) the copper concentration in said electrolyte portion is lowered to a value not below about 15 gpl.

5. The process of claim 2 wherein the anode formed in step (F) contains a total of about 5 wt.% to about 80 wt.% of said one or more impurity metals.

6. The process of claim 5 wherein the anode formed in step (F) contains a total of about 20 wt.% to about 50 wt.% of said one or more impurity metals.

7. The process of claims 2, 5, or 6 wherein the anode formed in step (F) contains less than about 1 wt.% iron.

8. The process of claim 2 wherein the anode formed in step (F) contains nickel, wherein in step (H) nickel dissolves from the anode into said electrolyte portion, and wherein in step (I) nickel sulfate is crystallized from said electrolyte portion.

9. The process of claim 8 wherein said electrolyte portion in the cell of step (G) contains nickel dissolved therein.

10. The process of claim 8 or claim 9 wherein said black copper product formed in step (A) contains at least about 10 wt.% nickel.

11. The process of claim 10 wherein the black copper product contains at least about 20 wt.% nickel.

12. The process of claim 2 wherein the electrolyte in the cell of step (G) is circulated therethrough at a rate below about 0.5 liters per pound of copper deposited at the cathode per hour.

13. The process of claim 8 wherein the anode formed in step (F) contains antimony, wherein in step (H) antimony forms a solid slimes phase in said electrolyte portion, and wherein in step (I) said slimes phase is separated from said electrolyte portion.

14. The process of claim 2 or claim 13 wherein the anode formed in step (F) contains tin, wherein in step (H) tin forms a solid slimes phase in said electrolyte portion, and wherein in step (I) said slimes phase is separated from said electrolyte portion.

15. A process according to claim 1 for recovering copper and nickel from roasted concentrates containing copper and nickel in oxidic states, comprising (i) providing a roasted copper concentrate containing about 5 wt.% to about 50 wt.% copper and less than about 1 wt.% nickel, substantially all of said copper and nickel being in oxidic states, and less than about 1 wt.% sulfur, (ii) smelting said roasted copper concentrate under conditions effective to recover therefrom a blister copper product containing at least about 95 wt.% copper and a copper-smelter slag, (iii) providing from said blister copper product an anode consisting essentially of copper and up to about 1 wt.% nickel, (iv) electrolytically refining the anode from step (iii) in an electrolytic cell comprising an aqueous sulfuric acid electrolyte in which are immersed the anode from step (iii) and a cathode, by impressing between said anode and said cathode a voltage effective to dissolve copper from said anode and preferentially deposit high-purity copper onto said cathode, wherein copper dissolves into said electrolyte at a rate which exceeds the rate of deposition of copper onto said cathode, (v) withdrawing a portion of the electrolyte, (vi) providing a roasted copper-nickel concentrate containing about 5 wt.% to about 50 wt.% copper, about 3 wt.% to about 35 wt.% nickel, about 3 wt.% to about 35 wt.% iron, and less than about 1 wt.% sulfur, substantially all of said copper, nickel, and iron being in oxidic states, (vii) treating at least a portion of said roasted copper-nickel concentrate under reducing conditions effective to recover therefrom a fully reduced metallic anode containing copper, less than about 2 wt.% iron, and an amount of nickel effective, on application of the voltage in step (ix), to lower the copper concentration in said electrolyte portion, and to recover therefrom also a copper-nickel smelter slag containing copper, nickel, and iron values, (viii) establishing an electrolytic cell comprising said electrolyte portion from step (v) having immersed therein the anode formed in step (vii) and a cathode, (ix) applying between the anode and the cathode in the cell of step (viii) a voltage effective to dissolve the anode in said electrolyte portion and to preferentially deposit copper from said electrolyte portion onto the cathode, whereby the copper concentration in said electrolyte portion is lowered and nickel dissolves from the anode into said electrolyte portion, (x) further treating said electrolyte portion to remove from solution therein an amount of nickel at least equal to the amount thereof contained in the anode formed in step (vii), thereby providing a purified electrolyte portion, and (xi) returning said purified electrolyte portion to step (iv).

16. The process of claim 15 further comprising treating said copper-smelter slag and said copper-nickel smelter slag to recover therefrom copper and nickel values, and recycling said copper and nickel values to step (vii).

17. The process of claim 15 wherein the electrolyte portion withdrawn in step (v) contains dissolved therein at least about 30 gpl copper.

18. The process of claim 15 wherein in step (ix) the copper concentration is lowered to a value not below about 15 gpl.

19. The process of claim 15 wherein the anode formed in step (vii) contains about 5 wt.% to about 50% nickel.

20. The process of claim 15 wherein the anode formed in step (vii) contains less than about 1 wt.% iron.

* * * * *